US005295528A

United States Patent [19]

Diyecha et al.

[11] Patent Number: 5,295,528

[45] Date of Patent: Mar. 22, 1994

[54] CENTRIFUGAL CASTING OF REINFORCED ARTICLES

[75] Inventors: Amarnath P. Diyecha, Falls Church; Subhash D. Karmarkar, Great Falls; William A. Ferrando, Arlington, all of Va.; Scott M. Hoover, Burtonsville, Md.

[73] Assignee: The United States of America as represented by the Secretary of the Navy, Washington, D.C.

[21] Appl. No.: 704,563

[22] Filed: May 17, 1991

[51] Int. Cl.[5] ..... B22D 13/02; B22D 19/02

[52] U.S. Cl. ..... 164/75; 164/98; 164/100; 164/112; 164/114

[58] Field of Search ..... 164/75, 97, 100, 112, 164/98, 114

[56] References Cited

U.S. PATENT DOCUMENTS

| | | | |
|---|---|---|---|
| 3,264,697 | 8/1966 | Price et al. | 164/75 X |
| 4,279,289 | 7/1981 | Ban et al. | 164/97 |
| 4,631,793 | 12/1986 | Shintaku et al. | 164/97 X |
| 4,899,800 | 2/1990 | Gallerneault et al. | 164/100 X |
| 4,958,763 | 9/1990 | Divecha et al. | 228/193 |
| 4,980,123 | 12/1990 | Gedeon et al. | 164/75 UX |

FOREIGN PATENT DOCUMENTS

| | | | |
|---|---|---|---|
| 59-16662 | 1/1984 | Japan | 164/97 |
| 1-254365 | 10/1989 | Japan | 164/97 |

*Primary Examiner*—J. Reed Batten, Jr.

*Attorney, Agent, or Firm*—John D. Lewis; Jacob Shuster

[57] ABSTRACT

A reinforcement made of a composite material is positioned inside of a centrifugal casting mold. Molten matrix metal is then introduced into the mold while being rotated about its longitudinal axis until the molten metal completely encapsulates the reinforcement.

22 Claims, 2 Drawing Sheets

CENTRIFUGAL CASTING OF REINFORCED ARTICLES

BACKGROUND OF THE INVENTION

The present invention relates in general to articles reinforced with discontinuous composites and the like, and a process of making the same, and in particular, to the use of preforms which can be used to form articles such as microstructurally toughened tubes by casting.

PRIOR ART

Discontinuous metal matrix composites (MMC) have relatively recently been used industrially. The most widely used discontinuous composites are silicon carbide whiskers (SiC) and silicon carbide particles (SiCp) or (SiCw).

Discontinuously reinforced aluminum is commonly designated as SiC/Al and SiCp/Al, respectively. These composites are manufactured by either powder metallurgy (PM) or ingot metallurgy (IM). The PM composites are considerably more expensive than the IM composites, but the PM composites are preferred in certain applications because of their higher strength.

At present time IM composites are limited to about twenty volume percent SiCp in one matrix; namely, A 356 aluminum alloy. A deterrent to their application and widespread use is their brittleness or lack of ductility. For example, in structural applications, designers demand fatigue resistance and fracture toughness at least equal to or greater than the contemporary material it is replacing. In most cases, metal matrix composites, including SiCp/Al, are brittle in the classical sense. Monolithic aluminum is tough material but SiC/Al is very brittle. An increase in strength and modulus (as achieved by incorporating SiC in Al) accompanied by a decrease in density, is not sufficient unless accompanied by good fracture toughness.

In one attempt to improve the toughness of discontinuous metal matrix composites, extruded rods of PM SiCp/Al composites were inserted in a soft aluminum tube. These were then assembled and hot isostatically compacted in a can to form a billet. This billet was then extruded at elevated temperatures using a moderate extrusion ratio. The resulting composite portion of the extruded billet contained a much smaller volume of SiC because of dilution of the matrix by the monolithic aluminum tubes. As expected, the composite strength and modulus were reduced proportionately by an amount which can be calculated by the law of mixtures.

However, in the above example, composite fracture toughness increases by an order of magnitude over that of the reinforced matrix, specifically the impact strength which is a good test for measuring the toughness of a material. The microstructurally toughened composite impact strength is found to be nineteen ft. lbs. as compared to a monolithic unreinforced aluminum matrix having a toughness of 3–4 ft. lb. The PM rods of $SiC/_{Al}$ by themselves also exhibit low impact strength ranging from 0.6 to 1.0 ft. lb.

It is also known to produce rods of graphite fiber reinforced glass matrix, known as Gr/glass which ha very high strength, low density and high modulus. This process toughens glass; consequently, the Gr/glass will not shatter like monolithic glass even under repeated blows.

It is desirable to have an economical process for producing microstructurally toughened, discontinuously reinforced tubes and other articles, in which a reinforcing material can be distributed at desired points within the wall of the tube. It is also desirable to have a process for producing microstructurally toughened discontinuous tubes in which hybrid composite combinations of materials forming the reinforcing material can be placed at critical locations within the tube wall.

SUMMARY OF THE INVENTION

A process is provided for forming a microstructurally toughened discontinuous composite tube or other article, having reinforcing members therein by casting in a hollow mold including the steps of (a) coating the reinforcing members, (b) prepositioning the coated reinforcing members inside the mold into pre selected locations and, (c) introducing molten matrix metal into mold to form a tubular shape incorporating the precast reinforcing members to microstructurally toughen the tube. In this way, tubes or other shapes can be produced with differing amounts of reinforcement means in any desired position in the tube wall and reinforcement members can be formed of composite materials which differs from the matrix metal being cast.

BRIEF DESCRIPTION OF THE DRAWING FIGURES

Other objects, advantages and novel features of the invention will become apparent from the following detailed description of the invention when considered in conjunction with the accompanying drawing wherein.

DESCRIPTION OF THE PREFERRED EMBODIMENT

Figure 1:
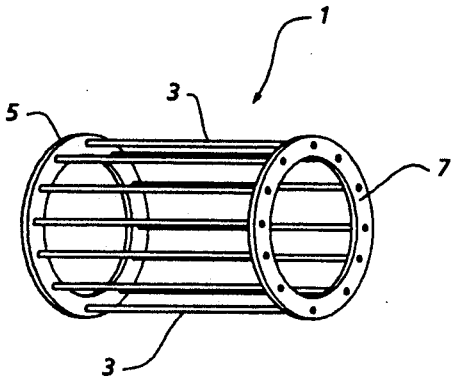
FIG. 1 is a perspective view of reinforcement according to one embodiment including a plurality of reinforcing ($SiC_p$Almmc) rods held in pre-selected positions in circular frames.
Figure 3:
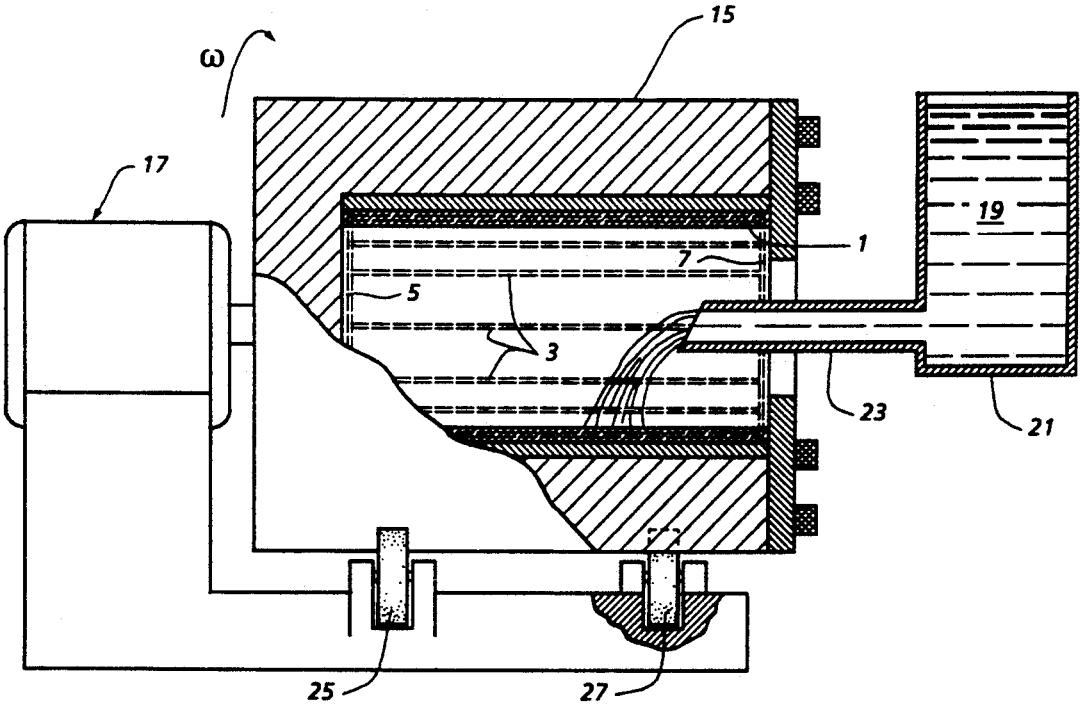
FIG. 3 is a cross-sectional view of a centrigual casting device illustrating the positioning of the reinforcement in the hollow mold when molten metal is introduced while carrying out centrifugal casting operation in the mold.

According to the process of the present invention, a reinforcement assembly shown generally at 1 in FIG. 1, comprises a plurality of longitudinally extending rods 3 held in preselected positions in circular frames 5 and 7 which are to be incorporated into the hollow mold shown generally at 15 in FIG. 3. The rods 3 are held in the desired position during the casting process by the circular holding frames 5 and 7. A motor shown generally at 17 causes the mold 15 (FIG. 3) to rotate according to a preferred embodiment of the invention while molten metal 19 held in crucible 21 discharges through spout 23 directly into the rotating mold 15 (FIG. 3). Rollers 25 and 27 upon which the mold 15 rests, support the mold 15 while it is being rotated during the casting operation.

Figure 2:
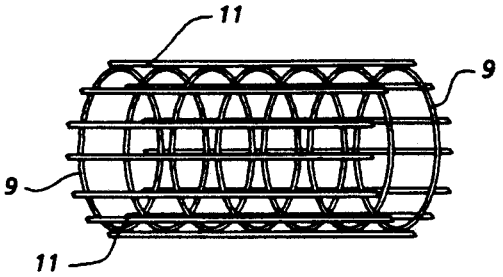
FIG. 2 is a perspective view of a reinforcement in the form of a plurality of hoop-shaped reinforcing rods held in preselected positions with longitudinally extending reinforcing rods.

In the embodiment shown in FIG. 2, the reinforcement comprises a plurality of hoop-shaped preformed composite materials Gr/Al, B/Al, Gr/glass, $B_4C$/metal, $Ni_3Al$/Cu, $SiC_p$/Al generally referred to as 9. The hoops 9 are interconnected in axially spaced relation by longitudinally extending rods 11 which are secured thereto. The reinforcement shown in FIG. 2 can be inserted in the cavity of mold 15 (not shown) to provide reinforcing support for the tube walls in much the same manner as the reinforcement shown generally at 1 and in FIG. 3.

Figure 4:
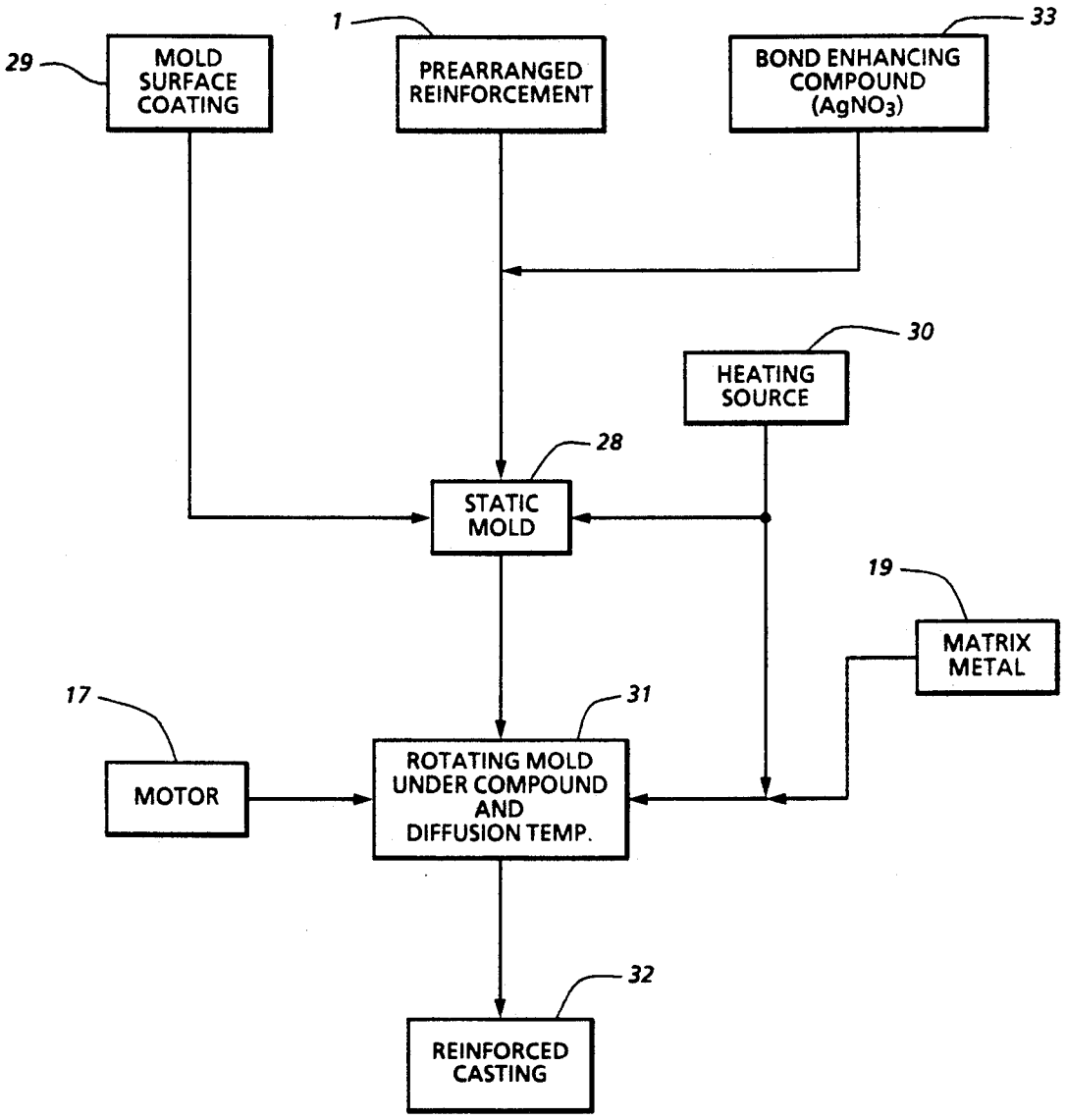
FIG. 4 is a diagram outlining the process of the present invention.

Preferably, in a typical casting operation as diagrammed in FIG. 4, the mold surface in a static condition 28 is coated with release compounds 29 such as alumina, graphite, clay and combinations of these materials. The mold is preferably heated to a temperature of 300° C. of superheat by a suitable heating source 30 prior to introducing the molten metal 19 into the mold 15 while in a rotating condition 31. Preferably the matrix metal which is held in the crucible 21 at a superheat of approximately 700° C., is introduced through nozzle 23 which is also preheated to about 250° C. The matrix metal 19 is introduced into the mold 15 while the motor 17 causes mold 15 to rotate at a high angular velocity. During this process, the matrix metal encapsulates the reinforcement before cooling and solidification of the matrix metal to form the reinforced casting 32 as diagrammed in FIG. 4. The parameters established for centrifugal casting of SiC/Al can be used with only minor changes in casting tubes having the reinforcing members according to the present invention.

A critical element of successful casting with the reinforcing rods is the coating step involving the formation of a silver coating layer from a compound 33 to provide a strong bond by shielding SiC/Al reinforcement from oxidation and from direct reaction with the hot metal matrix during the casting operation. The coating layer or interface also provides good wetting to the matrix aluminum such that subsequent thermal treatment can be employed to produce diffusion of silver into both reinforcement and matrix, further enhancing the bond strength.

The silver coating process utilizes the unique physical properties of the compound silver nitrate ($AgNO_3$). The coating process is disclosed in U.S. Pat. No. 4,988,673 and is disclosed more particularly with respect to the coating of aluminum in U.S. Pat. No. 4,958,763. The advantages of this relatively low temperature, simply applied method of silver coating are various. The most important, in the case of aluminum (and its alloys), is its apparent ability to displace the thin oxide layer which is always present on an aluminum surface sufficiently to allow diffusion of the silver into the aluminum surface producing the strong bond.

The $AgNO_3$ coating process is applicable to a wide spectrum of reinforcement and matrix alloys. For example, titanium or steel reinforcement could be used as well as Al-Mg or Al-Li alloys. The Ag coating thickness, which typically has been found to be about 10 microns, can be reduced by diluting the $AgNO_3$ prior to application or increased by repeating the coating steps.

According to one preferred embodiment, the reinforcing rods are formed of a composite material comprising a matrix which is similar to the matrix being centrifugally cast as the main component of the tubular shape. For example, where an aluminum or aluminum alloy tube is desired, the reinforcing rods are preferably made of a composite material such as SiC/Al and Al, Gr/Al, B/Al, or $B_4C$/Al.

One or more layers of the reinforcing rods may be incorporated into the tube to be cast. According to the present invention, many hybrid composite combinations can be used. For example, SIC/Mg can be cast with aluminum or its alloys to provide improved corrosion resistance. The process of the present invention can use numerous materials and composites, including intermetalic matrix composites, high temperature combinations such as $Al_2O_3$/INCO 718, $B_4C$/Cu, $Ni_3Al$ matrix reinforced with continuous SiC filaments ($Ni_3Al/SiC_F$) and $Ti_3Al/SiC_F$ to produce, respective, microstructurally toughened tubes and articles by centrifugal casting. Thus, nickel or its alloy may be cast around $Al_2O_3$-/INC0718 to obtain a reinforced and toughened tube analogous to $SiC_p$/Al in an aluminum alloy. If needed, copper or its alloy can be reinforced and toughened with $Al_2O_3$/INCO 718 rods. Many compatible combination of hybrid composites become possible.

According to the present invention, the use of the composite reinforcing members will result in an improvement in the fracture toughness without sacrificing stiffness and strength to a significant extent. The degree of improvement will depend upon the volume fraction of the monolithic component of the composite and its inherent toughness. The choice of being able to select the monolithic component makes it possible to tailor the properties of the tube. For example, a monolithic component of the reinforcing materials such as Al or its alloys can be used with $SiC_p$/Al reinforcing rods to produce an article having toughness 3 to 4 times that of the components themselves.

In a preferred embodiment, Gr/glass rods can be advantageously used with an aluminum matrix metal. The advantage of the Gr/glass over SiC/Al in this specific case is the oxidation resistance of the Gr/glass. While the silicon carbide/aluminum (SiC/Al) will oxidize during preheating of the mold, the Gr/glass will not. As a result, silver coating needed for protection and bonding of SiC/Al is unnecessary. In addition, glass matrix is easily wetted by molten aluminum or the alloys thereof. Therefore, the adhesion at the interface between the matrix and the rods (of Gr/glass) is virtually instantaneous. In a preferred embodiment, a tube of titanium or its alloys can be used to toughen the composite to a very high degree by inserting a rod of SiC-/Al into a titanium or titanium alloy tube which is preferably first silverized with $AgNO_3$. In this procedure, the rod is inserted into the titanium or titanium alloy tube and mildly swagged to create an intimate contact between the two mating surfaces. If necessary, the preform may be diffusion treated to create a bond at the interface between the silicon carbide/aluminum rod or the titanium or the titanium alloy tube. The rods prepared in this manner can then be placed in the mold in preselected positions and the centrifugal casting operation carried out in the manner that is described above. The advantage of this embodiment over the other composites described hereinbefore is that the titanium or titanium alloy is much stronger and tougher than aluminum and its alloys. Titanium and its alloys are also stiffer than aluminum with a modulus of 14 Msi. Also, the titanium and titanium alloy is denser than both aluminum and SiC/Al and therefore the resultant composite tube will be heavier than one without the titanium or the titanium alloy. This particular embodiment is suitable where toughness is the most important criteria. In another preferred embodiment, the titanium or titanium alloy tube can be used with a rod swagged therein of $B_4C_p$/Cu or $Al_2O_3/Ni_3$/Al.

It is believed that one skilled in the art can, using the preceding description, utilize the present invention to its fullest extent. The previously described preferred specific embodiments are, therefore, to be construed as merely illustrative and not limitative of the remainder of the disclosure in any way whatsoever.

Numerous other modifications and variations of the present invention are possible in light of the foregoing teachings. It is therefore to be understood that within the scope of the appended claims the invention may be practiced otherwise than as specifically described.

What is claimed is:

1. A process of forming a hollow composite metallic article having a nonwoven reinforcement comprising a composite rod or tube having a metal component therein by a centrifugal casting operation in a rotating mold, including the steps of:

positioning the reinforcement inside the mold;

introducing molten matrix metal into the rotating mold to encapsulate the reinforcement therein; and cooling the matrix metal with the reinforcement therein to complete the casting operation.

2. Process of claim 1, wherein the reinforcement is a plurality of rods or tubes of a composite material positioned at preselected location inside, the mold.

3. Process of claim 1, wherein the reinforcement is silicon carbide reinforced aluminum rod.

4. Process of claim 1, wherein the reinforcement is graphite/glass reinforced aluminum rod.

5. Process of claim 1, wherein the reinforcement is graphite/glass reinforced magnesium rod.

6. Process of claim 1, wherein the reinforcement is boron carbide reinforced magnesium rod.

7. Process of claim 1, wherein the reinforcement is $Ni_3Al$ reinforced copper rod.

8. Process of claim 1, wherein the reinforcement is boron fiber reinforced aluminum rod.

9. Process of claim 1 wherein the reinforcement is a tube of titanium filled with a rod of a composite material.

10. Process of claim 9, wherein the rod of composite material is SiC/Al.

11. Process of claim 2, wherein the preselected locations of rods of composite material form a hoop-shaped arrangement.

12. Process of claim 11, wherein said rods in the preselected positions are held by a rod extending perpendicular to the hoop-shaped arrangement and attached thereto.

13. A process of forming a hollow composite article having a nonwoven reinforcement comprising a composite rod or tube having a metal component therein by a centrifugal casting operation in a rotating mold, including the steps of:

(a) positioning the reinforcement inside the mold in preselected locations internally of the article to be cast;

(b) introducing molten matrix metal in a molten condition into the rotating mold until the metal completely encapsulates the reinforcement; and (c) cooling the matrix metal to solidification forming the article with the composite reinforcement incorporated therein.

14. The process of claim 13, including the step of rotating the mold about a longitudinal axis thereof while the matrix metal is being introduced.

15. The process of claim 14, wherein the reinforcement is a plurality of precast rods extending parallel to the longitudinal axis of the mold at said preselected locations.

16. The process of claim 14, wherein the reinforcement is precast hoops of a composite material extending perpendicular to the longitudinal axis of the mold at said preselected location therein.

17. In combination with the process of claim 14, the step of: coating the reinforcement prior to positioning thereof inside the mold to enhance subsequent bonding with the matrix metal in the molten condition thereof.

18. The process of claim 17 wherein the reinforcement is a composite having aluminum as a component thereof, and said coating is a silver compound from which decomposed silver diffuses into the matrix metal and the aluminum of the reinforcement under temperatures maintained in the matrix in the molten condition within the mold.

19. In a process of forming a hollow composite article made of metal having a nonwoven reinforcement comprising a composite rod or tube having a metal component therein, including the steps of: coating the reinforcement with a bond enhancing compound; positioning the coated reinforcement within a mold of a centrifugal casting device; introducing the metal in a molten state into the mold to encapsulate the reinforcement; and maintaining the mold during said introduction of the metal under an internal temperature causing decomposition of the bond enhancing compound into an interfacing material which diffuses into the reinforcement and the metal in the molten state.

20. The process as defined in claim 19 wherein said interfacing material is silver.

21. The process as defined in claim 20 wherein the mold is rotated during said introduction of the metal in the molten state.

22. The process as defined in claim 19 wherein the mold is rotated during said introduction of the metal in the molten state.

* * * * *